US006414645B1

(12) United States Patent
Dahlberg

(10) Patent No.: US 6,414,645 B1
(45) Date of Patent: Jul. 2, 2002

(54) CIRCULARLY POLARIZED NOTCH ANTENNA

(75) Inventor: Scott E. Dahlberg, St. Peters, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/924,695

(22) Filed: Aug. 8, 2001

(51) Int. Cl.[7] ..... H01Q 13/10

(52) U.S. Cl. ..... 343/767; 343/756; 343/705

(58) Field of Search ..... 343/767, 768, 343/756, 705

(56) References Cited

U.S. PATENT DOCUMENTS

| | | | | | |
|---|---|---|---|---|---|
| 4,431,999 | A | | 2/1984 | Gutleber | 343/381 |
| 4,531,130 | A | | 7/1985 | Powers et al. | 343/767 |
| 5,081,466 | A | * | 1/1992 | Bitter, Jr. | 343/767 |
| 5,406,292 | A | | 4/1995 | Schnetzer et al. | 343/780 |
| 5,949,382 | A | * | 9/1999 | Quan | 343/767 |
| 6,239,762 | B1 | | 5/2001 | Lier | 343/770 |

* cited by examiner

*Primary Examiner*—Don Wong
*Assistant Examiner*—Hoang Nguyen
(74) *Attorney, Agent, or Firm*—Harness Dickey & Pierce P.L.C.

(57) ABSTRACT

A circularly polarized single point feed notch antenna functions on land, sea, air and space vehicles and communicates using a broad frequency range while maintaining stealth during installation on a fighter aircraft by demonstrating a low Radar Cross Section (RCS). The circularly polarized notch antenna (CPNA) employs a phase delay card polarizer to achieve circularly polarized radiation or reception. The CPNA couples non-planar conductive fins to opposing sides of a non-conducting polarizing member. The fins fashion a ninety degree longitudinal fold, tuning slots at one fin end for tuning the antenna, and bifurcated arms at an opposing end formed by a notch. The bifurcated fins possess curved edges running from a part exterior to a part interior and a recession on the fold beginning near the tuning notch(es) and running the fin length until the recession runs out when it meets the curved edge.

22 Claims, 7 Drawing Sheets

CIRCULARLY POLARIZED NOTCH ANTENNA

FIELD OF THE INVENTION

The present invention relates to a communications antenna. More specifically, this invention relates to a circularly polarized notch antenna with a single point feed, a low radar cross section, and a broad band frequency range suited for land, sea; air and spacecraft use.

BACKGROUND OF THE INVENTION

Antennas are commonly employed to transmit, receive, enhance or ensure the reception of a signal within a desired frequency range depending upon the particular antenna design and specific application. Such signals are often transmitted and received at frequencies commonly employed to transmit audio and video signals. While present day antennas have generally proven to be satisfactory for their given applications, each often has limitations which limit its use in some manner.

One limitation with many present day antennas used on aircraft is their inability to maintain stealth, or in other words, to remain undetectable by radar. Maintaining stealth is particularly important with regard to certain military aircraft applications. In order to help maintain aircraft stealth, the Radar Cross Section (RCS) of an aircraft becomes important. RCS is a measure of the radar reflection characteristics of a target, or comparatively, a measure of the cross section of the sphere that would reflect the same energy back to a radar system irradiating the target if the sphere were substituted. As RCS increases, the integrity of aircraft stealth decreases and the aircraft becomes vulnerable to detection by radar. Therefore, it is highly desirable for certain military aircraft to maintain stealth by having a low RCS.

Another limitation of antennas used on most vehicles and with many land installations relates to the physical presence that most antennas must have in order to effectively transmit and receive signals. Most antennas must be exteriorly mounted on a vehicle or land based structure, or otherwise mounted to provide a relatively unobstructed transmission path to a receiver or transmitter. This requirement greatly limits antenna mounting locations, especially for military aircraft applications, and also greatly increases the RCS of the vehicle or aircraft, thus jeopardizing the ability of the vehicle or aircraft to operate undetected by a radar system.

Yet another limitation of antenna installations on military aircraft for electronic warfare transmission includes the number of antenna feed points. An antenna feed point is a point on an antenna where an electrical feed line couples to the antenna to transmit and receive RF signals within the frequency band that the antenna is designed to transmit and receive. Many modern antennas have dual feed points. The number of feed points directly contributes to the complexity of the antenna, its overall manufacturing cost and antenna utilization for a given application.

Still another limitation of antennas is their inability to transmit in a circularly polarized fashion. Many antennas, by the nature of their design, are capable of transmitting and receiving frequencies in a vertically or horizontally polarized fashion, but not circularly. Circular polarization is desirable in most transmissions related to military aircraft communications.

The problem of maintaining an aircraft's stealth with regard to antennas has been addressed by the prior art by designing antennas capable of providing a low RCS. A crossed notch antenna is a type of antenna that is capable of providing a low radar cross section. However, a crossed notch antenna utilizes multiple feed points. Additionally, the problem of reducing the number of antenna feed points has been addressed by the prior art with the traditional horn antenna which commonly has a single feed point. However, horn antennas traditionally have a high radar cross section which jeopardizes aircraft stealth. Finally, the problem of transmitting a signal in a circularly polarized fashion has been addressed by the prior art with the crossed notch antenna. However, with a cross notched antenna, an additional external phase shift network is required to create the desired circular polarization.

What is needed then is an antenna that does not suffer from the above limitations. Ideally, such an antenna will provide for a single feed point that eliminates the problem of high RCS, and will thus provide a device that is capable of maintaining a low RCS thereby permitting an aircraft or other vehicle to maintain stealth. Additionally, such an antenna would be able to communicate using horizontal, vertical and circulating polarized signals without the need for an external phase shift network. This will permit savings with respect to antenna manufacturing assembly time, antenna installation time, and will provide an overall less complex antenna design.

SUMMARY OF THE INVENTION

In accordance with the teachings of the present invention, a circularly polarized notch antenna is disclosed. The invention provides an antenna with a planar polarizing member and multiple non-planar fins coupled to opposing polarizer sides. The invention also provides an electrical connection assembly that connects to the fins to communicate RF signals using a broad band of frequencies.

In one preferred embodiment, a circularly polarized notch antenna adaptable for use on land, sea, air and space vehicles includes a planar polarizing member, dual non-planar fins that are mechanically coupled to the polarizer, and a connection assembly that provides electrical connection to the antenna. The planar polarizing member is preferably square or rectangular,. manufactured from a dielectric material such as plastic or ceramic, and includes an elongated center slot. The fins are non-planar, preferably formed so as to include a ninety degree angle, and attached to opposing sides of the polarizing member. Additionally, each fin includes at one end at least one tuning slot, and at the other end dual curved edges formed by a notch, beginning at a fin interior and leading to a fin exterior. The connection assembly is typically a coaxial cable with an end coupler. In a dual, opposing fin arrangement, the outer conductor of the coaxial cable makes contact with one fin and the inner coaxial cable wire makes contact with the remaining fin. The cable passes through the elongated polarizer slot to facilitate the connection.

When the antenna parts are assembled, part reduction, overall antenna size and part complexity advantages are realized by eliminating the parts associated with an external phase shift network-and multiple feed cables or lines. Additionally, the notch antenna design of the present invention enhances electronic performance by communicating over a broader frequency range than traditional antennas.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
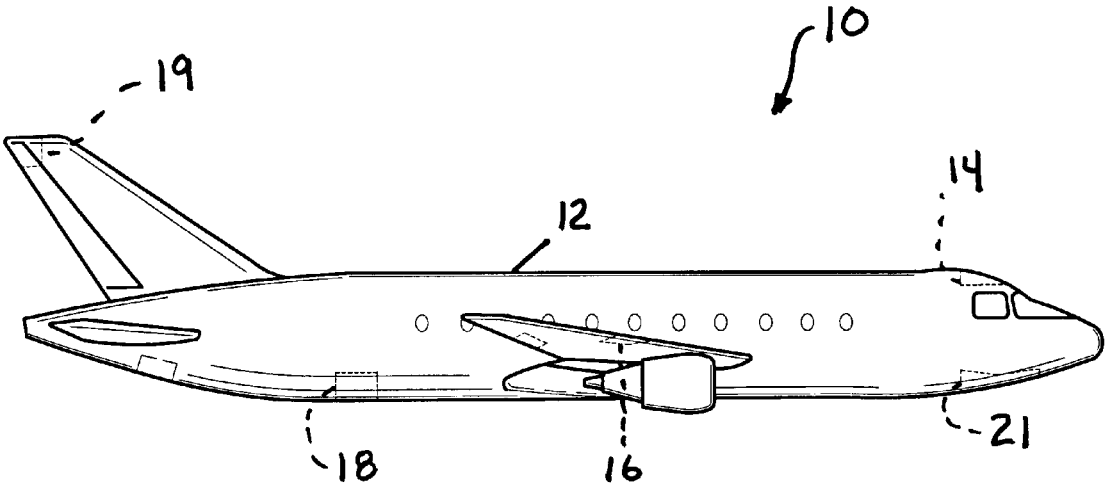
FIG. 1 is a perspective view of a commercial aircraft showing, in phantom, potential locations of the circularly polarized notch antenna of the present invention.
Figure 2:
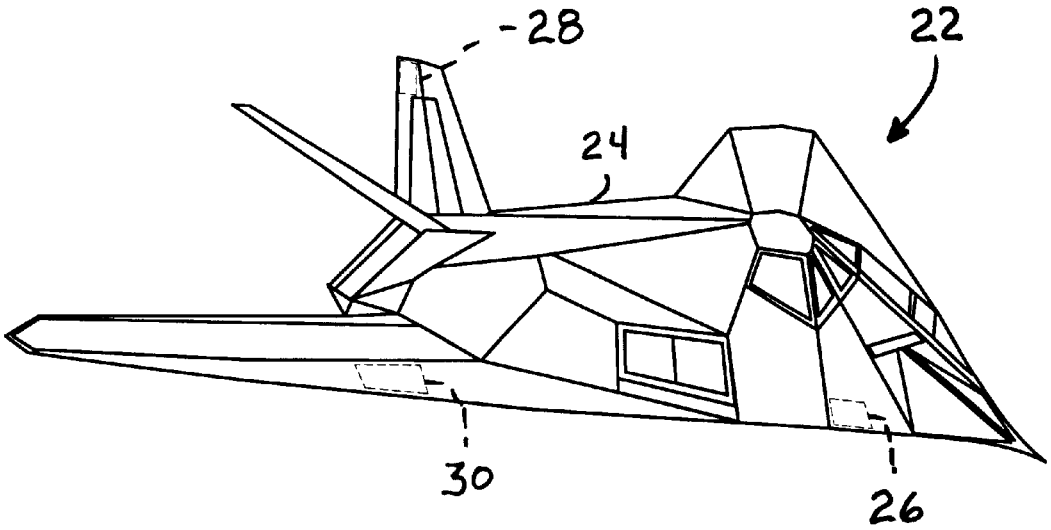
FIG. 2 is a perspective view of a military aircraft showing, in phantom, potential locations of the circularly polarized notch antenna of the present invention.

With reference to FIG. 1 of the drawings, a perspective view of a private or commercial aircraft 10 having a fuselage 12 depicts the potential locations 14, 16 and 18, 19 and 21 in phantom, of a circularly polarized notch antenna (CPNA) 20 (FIG. 5) in accordance with the teachings of the present invention. In this example, CPNA 20 is shown at location 14. FIG. 2 is a perspective view of a military aircraft 22 having a body 24 and showing the potential locations 26, 28 and 30, in phantom, of CPNA 20 (FIG. 5) in accordance with the teachings of the present invention. In this illustration, CPNA 20 is shown at location 26. The CPNA 20 of the present invention may be mounted exteriorly of the aircraft 10 or 22 or vehicle or flush mounted, below the surface of the aircraft or vehicle. Locations 14, 16 and 18 of FIG. 1 and locations 26, 28 and 30 of FIG. 2 are merely exemplary installation positions of the CPNA 20. The CPNA 20 of the present invention is mountable virtually anywhere communications are needed, including on, for example, land based vehicles and ships, as well as in fixed locations on ground based structures or on space based vehicles or structures.

Figure 3A:
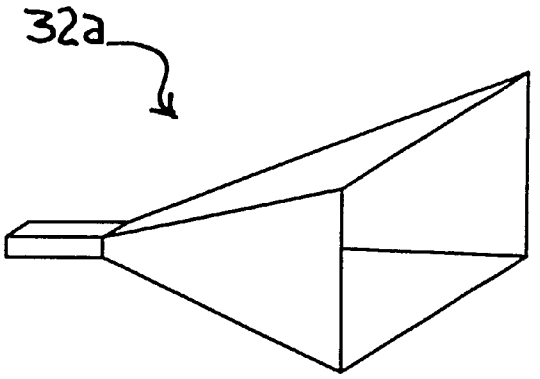
Figure - 3a PRIOR ART
FIG. 3*a* is a perspective view of a prior art pyramidal horn antenna.
Figure 3B:
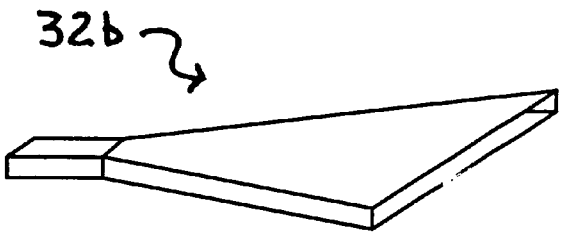
Figure - 3b PRIOR ART
FIG. 3*b* is a perspective view of a prior art sectoral H-plane horn antenna.
Figure 3C:
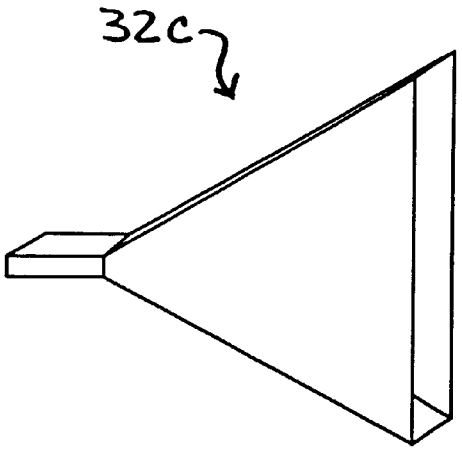
Figure - 3c PRIOR ART
FIG. 3*c* is a perspective view of a prior art sectoral E-plane horn antenna.
Figure 3D:
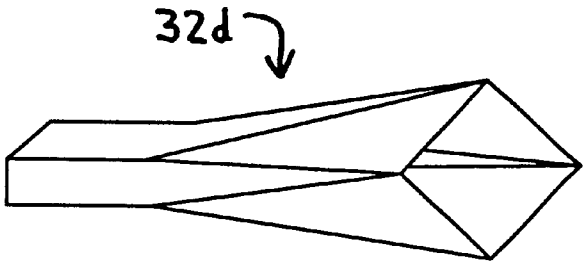
Figure - 3d PRIOR ART
FIG. 3*d* is a perspective view of a prior art diagonal horn antenna.

Previous and current antenna installations on commercial and military aircraft for electronic transmissions include a variety of antenna types. The horn antenna is one type of prior art antenna having multiple embodiments as shown in FIGS. 3*a*–3*d*. FIG. 3*a* shows a pyramidal horn antenna 32*a*, FIG. 3*b* shows a sectoral H-plane horn antenna 32*b*, FIG. 3*c* shows a sectoral E-plane horn antenna 32*c* and FIG. 3*d* shows a diagonal horn antenna 32*d*. While horn antennas are a very popular antenna, they exhibit a high radar cross section (RCS) which makes them undesirable for military use.

The RCS is a measure of the radar reflection characteristics of a target. RCS is equal to the power reflected back to the radar divided by the power density of the radar signal irradiating the target. Additionally, the RCS is regarded as the cross sectional area of a sphere that would reflect an equivalent amount of energy back to the radar if the sphere could be substituted. It is always desirable to maintain the minimum RCS possible on military aircraft to preserve the stealth, or undetectibility, of the aircraft.

In addition to RCS, an antenna feature known as antenna feed points will be explained. An antenna feed point is a mechanical antenna connection point that connects to a corresponding communications link used to transmit communications to and from the antenna. A coaxial cable is a common communications link connected to an antenna feed point. Generally, antennas have single or dual feed points with a single feed point being generally desirable over dual feed points since a single feed point makes an antenna less complicated, less expensive, and easier to install and subsequently troubleshoot than a multiple feed point antenna.

Figure 4:
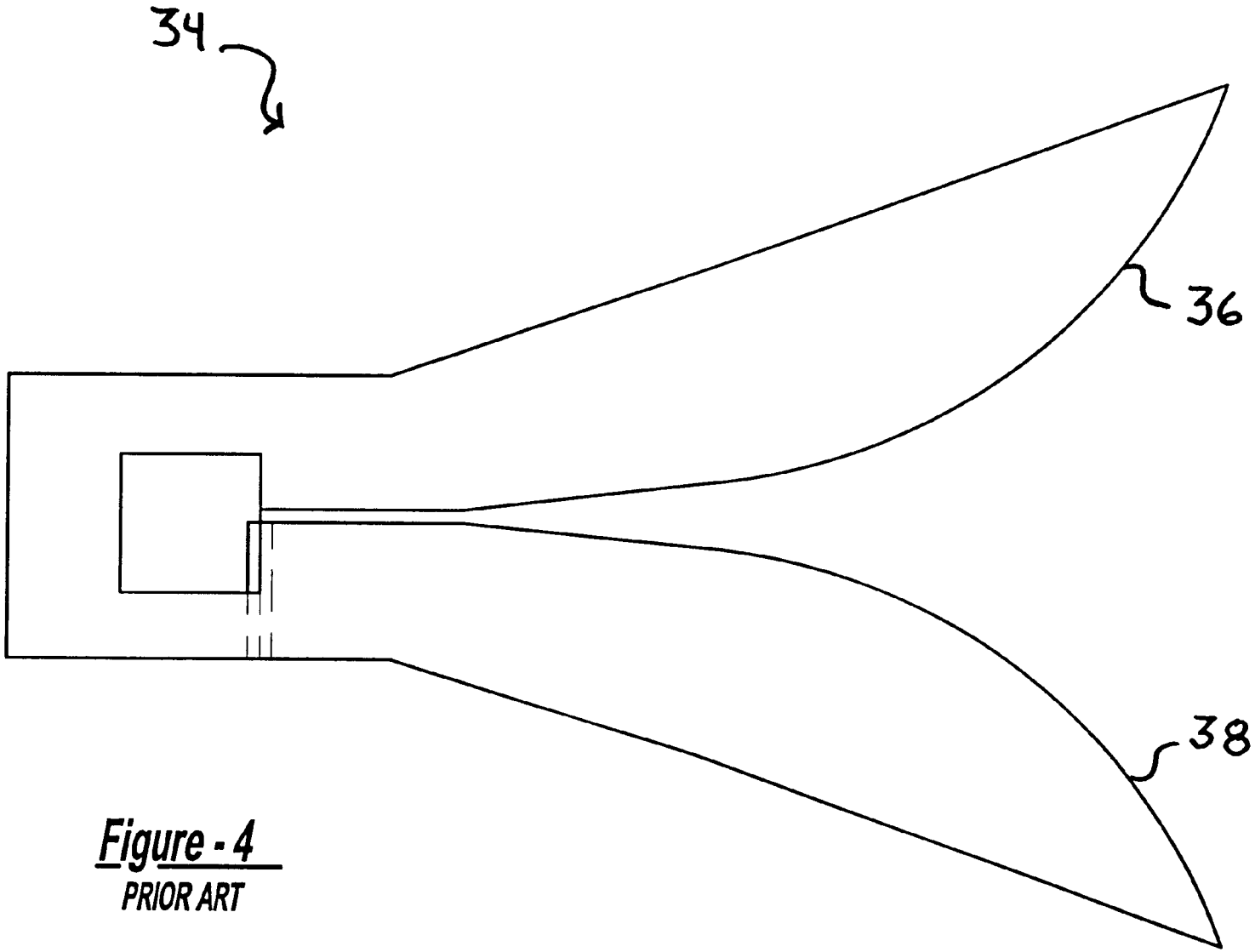
Figure - 4 PRIOR ART
FIG. 4 is a perspective view of a prior art notch antenna.

Another type of prior art antenna is a notch antenna 34, also known as a Vivaldi antenna, depicted in FIG. 4. Compared to the horn antennas of FIGS. 3*a*–3*d*, the notch antenna 34, with bifurcated portions 36 and 38, formed by a notch, generally has a lower RCS, but requires dual feed points and an external phase shift network to generate and receive circularly polarized signals which is required for many communication applications, especially military applications. External phase shift networks are generally complicated, expensive and may have electronic performance shortcomings for a given antenna application. In comparison to the CPNA 20 of the present invention, horn antennas and notch antennas are complicated, more expensive to manufacture and maintain, and have electronic or communication shortcomings. The CPNA 20 of the present invention will now be described in greater detail.

Turning to FIGS. 5–8, a preferred embodiment of the CPNA 20 of the present invention is shown, The CPNA 20 generally includes a polarizer 40, fin 42, fin 44, elongated polarizer slot 46, coaxial cable 48, tuning slot cluster 50, coaxial coupler 52 and feed wire 54. The typical coaxial coupler 52 contains inner threads (not shown). The feed wire 54 typically inserts into a feed point 56 such as that shown on fin 44 of FIG. 6, which is at an approximate center of the CPNA 20 fin apex.

The polarizer 40 is typically a dielectric material such as plastic or ceramic. The polarizer 40 is placed between antenna fins 42 and 44 and serves as both a mounting structure for the opposing fins and a spacer to adjust the fins for antenna tuning purposes. Antenna tuning is necessary in order for the antenna to receive and transmit RF signals at its intended frequencies. The end view of the CPNA, in FIG.

Figure 7:
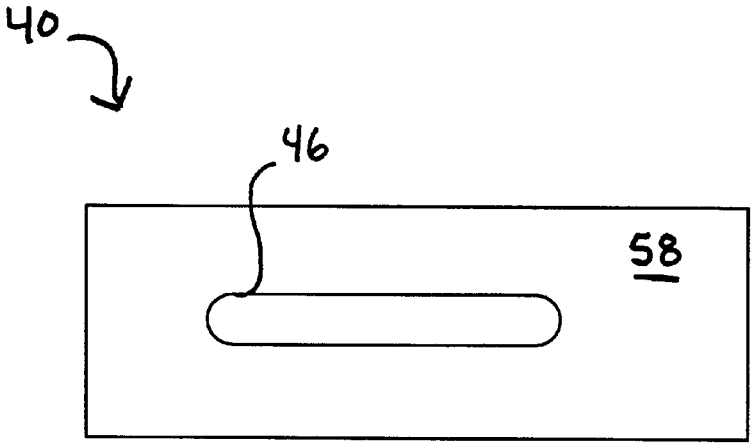
FIG. 7 is a side view of a polarizer of the circularly polarized notch antenna of the present invention.
Figure 8:
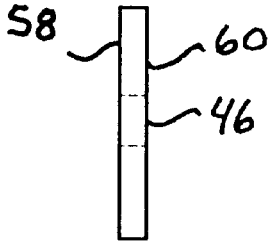
FIG. 8 is an end view of a polarizer of the circularly polarized notch antenna of the present invention.
Figure 9:
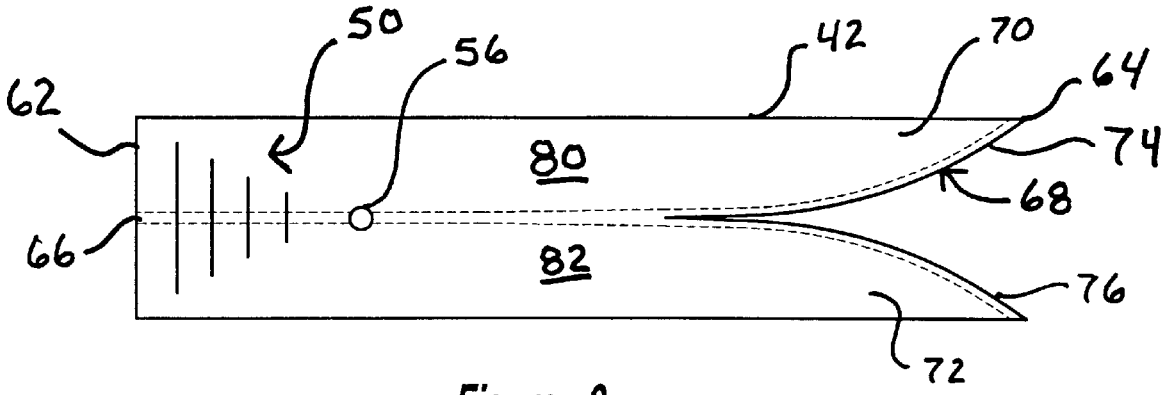
FIG. 9 is a top view of a fin of the circularly polarized notch antenna of the present invention.
Figure 10:
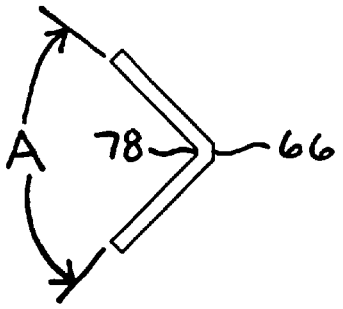
FIG. 10 is an end view of a fin of the circularly polarized notch antenna of the present invention.
Figure 11:
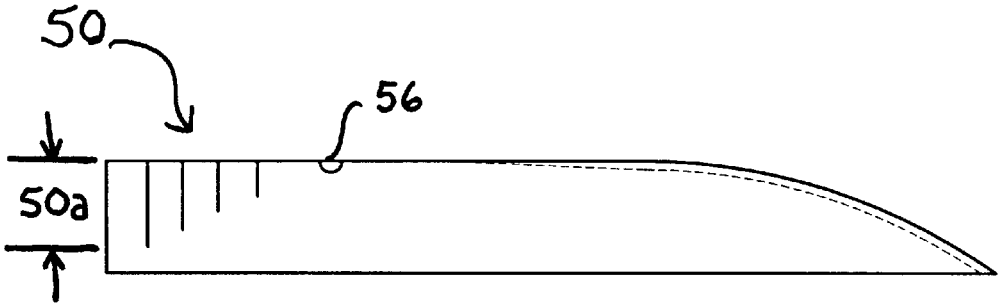
FIG. 11 is a front view of a fin of the circularly polarized notch antenna of the present invention.

6 shows that polarizer 40 has opposing surfaces 58 and 60 necessary to mount fins 42 and 44. The fins 42 and 44 are mounted on the polarizer 40 so as to be in generally facing relation to one another but offset laterally from one another. FIGS. 7 and 8 show the polarizer 40 containing the exemplary, elongated polarizer slot 46 which passes through the polarizer 40 proximate to the polarizer center. Those skilled in the art will realize that the size and precise location of elongated polarizer slot 46 will vary depending, upon the location of antenna feed point 56. The desired tuning of the CPNA 20 may also require adjusting the lengths of the notches of fins 42 and 44. Furthermore, the polarizer 40 itself may take on a variety of sizes depending upon the sizes of fins 42 and 44 and the tuning requirements of the CPNA 20.

FIGS. 5 and 9–11 show a typical fin 42 which will now be explained in greater detail. The fins 42 and 44 are typically manufactured from a piece of conductive metal such as aluminum, although those skilled in the art will realize that any electrically conductive metal will suffice depending upon the structural and physical limitations of the particular metal. The fin 42 is shown with a fold 78 and an included angle "A" of 90 degrees, although those skilled in the art will realize that the included angle "A" may vary depending upon the antenna RF tuning requirements and effect on the antenna RCS. Fin 42 has a first end 62, a second end 64, and a fold 78 coincident with a flat 66 that runs the longitudinal length of fin 42. The first end 62 has a tuning slot cluster 50 cut into it while the second end 64 has a notch 68 which forms bifurcated portions 70 and 72. The notch 68 creates curved edges 74 and 76 on the bifurcated portions 70 and 72 of fin 42. The shape and thin metal of notch 68 enable the CPNA 20 of the present invention to maintain its low RCS, making it advantageous for military applications. The ratio of the overall width of one opposing set of fins to the other can be used to adjust the polarization of this invention (i.e., the ratio of vertical to horizontal polarization).

Figure 5:
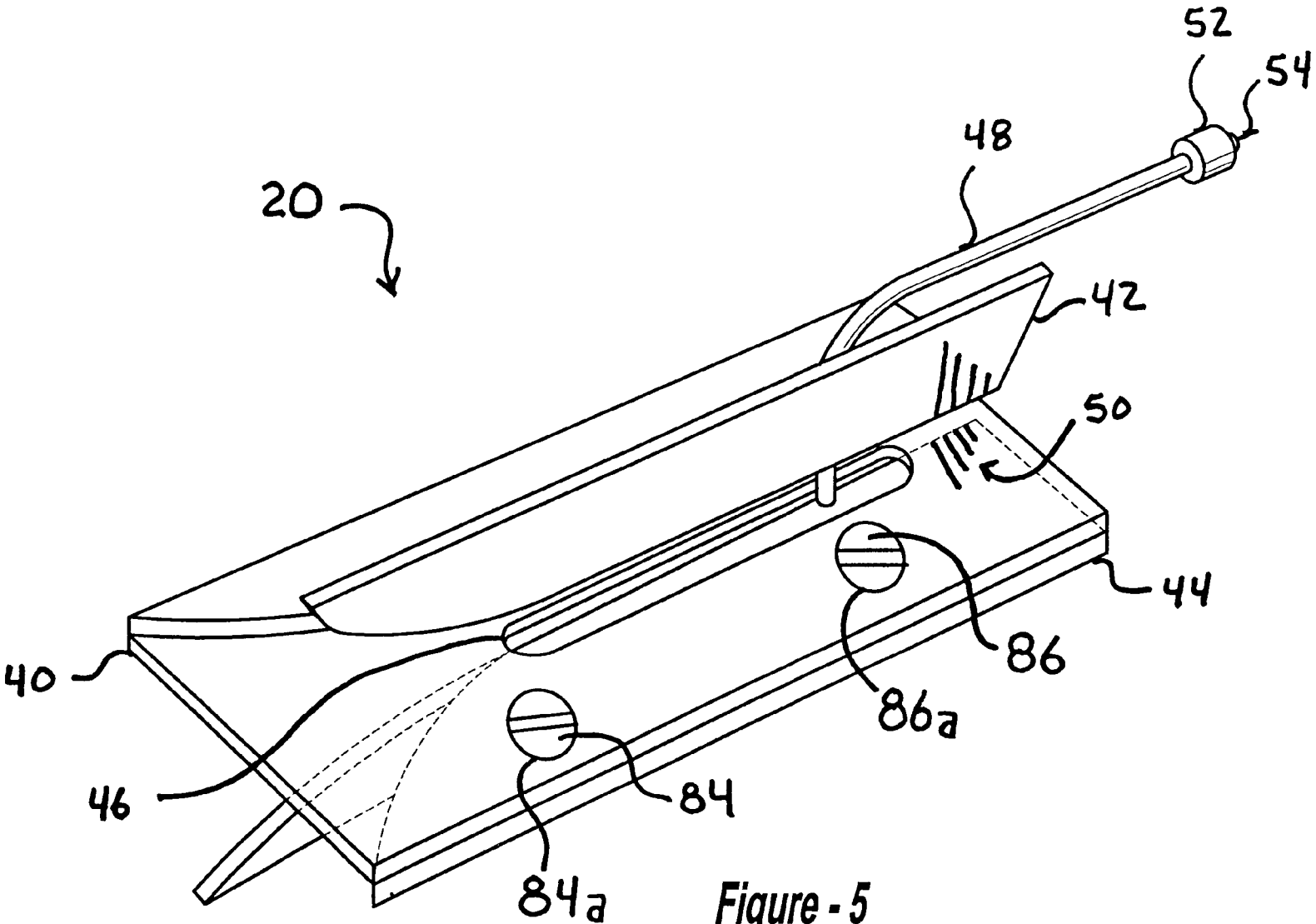
FIG. 5 is a perspective view of the circularly polarized notch antenna of the present invention.
Figure 6:
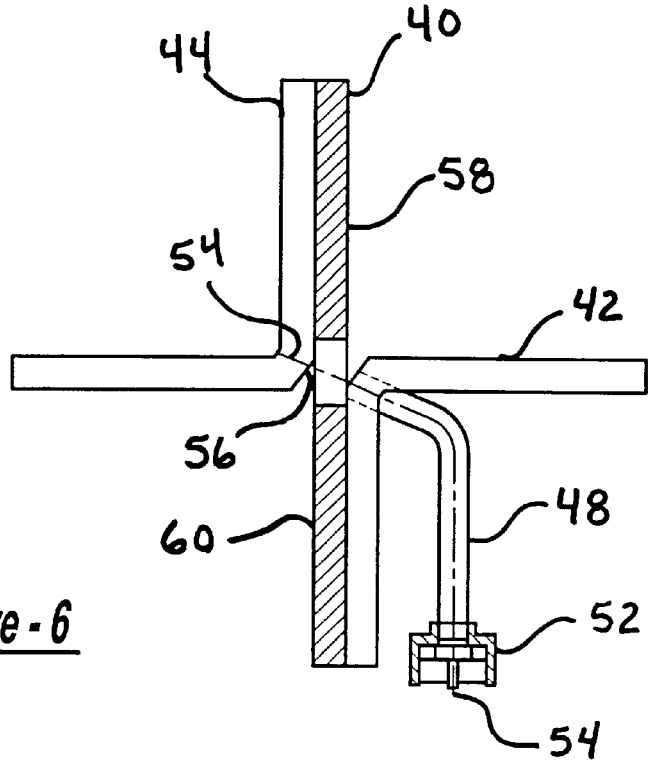
FIG. 6 is an end view of the circularly polarized notch antenna of the present invention.

Those skilled in the art will realize that the positions of feed point 56 and tuning slot cluster 50 are adjustable and depend upon the CPNA 20 tuning requirements. The flat 66 runs opposite fold 78 about which the fin 42 is a mirror image. When the fold 78 ends and the notch 68 begins, the flat 66 splits between the curved edges 74 and 76 and runs coincident with each edge. The fin 42 also has a first flat surface 80 and a second flat surface 82. With reference to FIG. 5, a flat surface of fin 42 is used for mounting to the polarizer 40. Fin mounting is accomplished in the present invention with a plurality of dielectric screws 84 and 86 which extend through holes 84a and 86a, respectively, in one of the fins 42 or 44. However, any traditional fastening means, such as rivets, clip-type fasteners, adhesives, or any other suitable attachment means may suffice to secure the CPNA 20 to a supporting structure.

In order to tune the CPNA 20, several physical attributes of the antenna must be adjusted. For instance, the tuning slot cluster 50 can be shifted toward the first end 62 or the second end 64 of fin 42. Furthermore, the tuning slot depth 50*a* (FIG. 11) and number of slots may be changed and the feed point 56 location adjusted accordingly. Tuning the CPNA 20 permits the desired bandwidth to be received. Furthermore, the CPNA 20 is tunable for input impedance matching by utilizing the feed line placement. The impedance of the coaxial cable 48 and its coaxial coupler 52 are typically 50 ohms for aircraft and microwave applications and are typically difficult to change. However, the CPNA 20 impedance can be altered to match the impedance of its coaxial coupler 52 and cable 48. This is accomplished by moving the feed point 56 of the CPNA 20. Finally, the placement of fins 42 and 44 on polarizer 40 plays a role in tuning the CPNA 20. That is, varying the location of fins 42 and 44 on polarizer 40 will affect the tuning of the CPNA 20.

Figure 12:
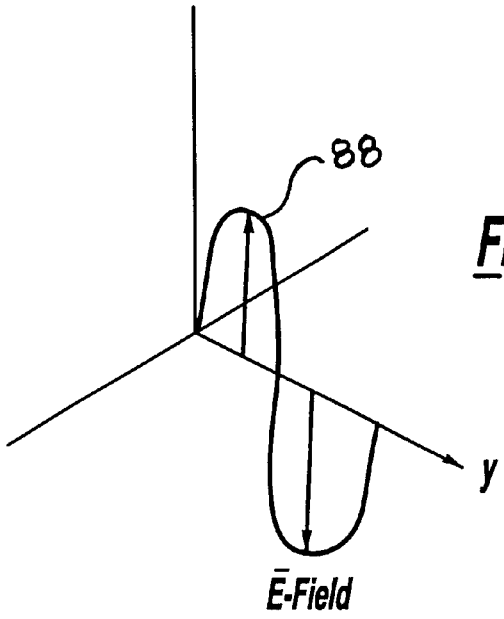
FIG. 12 is a plot showing a vertically polarized wave.
Figure 13:
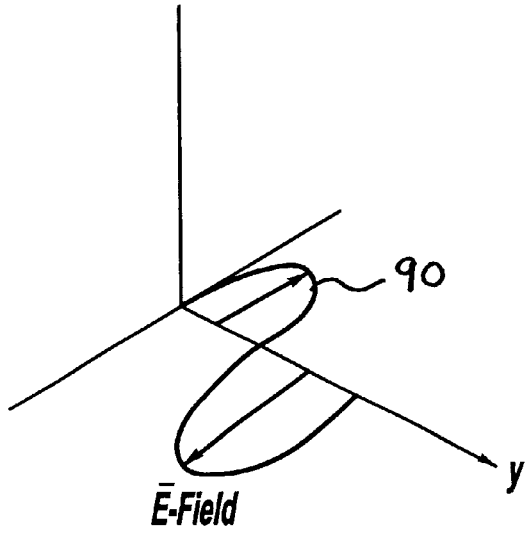
FIG. 13 is a plot showing a horizontally polarized wave.
Figure 14:
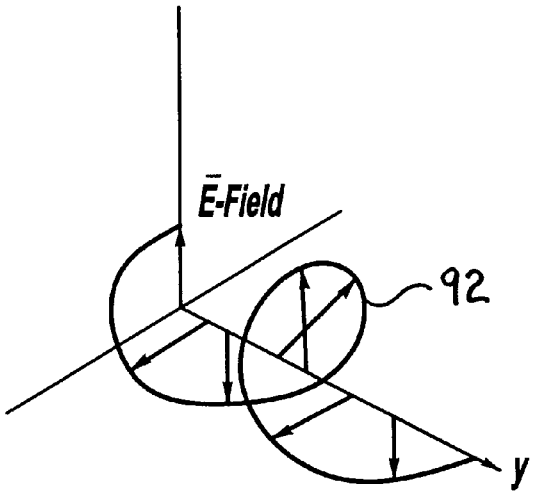
FIG. 14 is a plot showing a circularly polarized wave.

An important factor related to antenna tuning is signal transmission. The CPNA 20 is capable of transmitting RF signals at frequencies used in radio, video, microwave, and cell phone transmissions. Actually, the CPNA 20 can be used for any frequency since the CPNA 20 bandwidth is 300%, or 3:1. One distinct advantage of the CPNA 20 is its ability to receive and transmit circularly polarized RF signals. Polarization is known as the direction of the electric field as radiated from a transmitting antenna. Generally, monopole and dipole antennas oriented in a horizontal plane, generate horizontally polarized waves. Conversely, vertically oriented antennas are considered vertically polarized and generate vertically polarized RF signals. FIGS. 12 and 13 show representative examples of a vertically polarized wave 88 and a horizontally polarized wave 90, respectively. Signals that are vertically polarized are best received by a vertically oriented antenna and horizontally polarized antennas are best suited for reception of horizontally polarized signals. FIG. 14 shows a representative example of a circularly polarized wave 92. A circularly polarized wave is one whose electric field varies in a circle, as opposed to horizontally or vertically.

The CPNA 20 of the present invention not only implements a single point feed 56 but also uses a polarizer 40 to enable the reception and/or transmission of circularly polarized RF signals. The polarizer 40 is one method of causing the rotation of a linear polarized signal as it travels through space, creating the resulting circular polarization of the outgoing wave. The polarizer 40 also allows circularly and linearly polarized incoming signals to be received as linear signals.

While the present invention is shown in cooperation with private or commercial aircraft 10 and military aircraft 22, those skilled in the art will appreciate that the CPNA 20 of the present invention serves multiple applications. For instance, the CPNA 20 is not only suited for private, commercial and military air use, as noted above, but also for all land, sea, air and space use. Of particular benefit is that the CPNA 20 of the present invention enables circularly polarized signals to be received and/or transmitted while still providing a less complex antenna design, in addition to an antenna design which has a low RCS.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An antenna for receiving or transmitting at least one of vertically, horizontally and circularly polarized radio frequency signals, said antenna comprising:

a polarizing member having a first side and a second side;

a plurality of non-parallel disposed fins forming a fin assembly coupled to said polarizing member; and an electrical connector, said electrical connector passing through said polarizer and connecting said fins.

2. The antenna of claim 1 wherein said polarizing member includes a polarizing slot running longitudinally along a portion of said polarizing member.

3. The antenna of claim 2 wherein said polarizing slot is centered within a transverse width of said polarizing member.

4. The antenna of claim 1 wherein said fin assembly further comprises a first end and a second end, said first end including a plurality of tuning slots.

5. The antenna of claim 4 wherein said tuning slots are formed transversely to a longitudinal axis of said fin assembly.

6. The antenna of claim 1 wherein said fin assembly further comprises a first end and a second end, said second end further comprising a notch forming bifurcated dual edged curved profiles.

7. The antenna of claim 1, wherein each said fin comprises a pair of planar surfaces extending at a generally right angle to one another.

8. The antenna of claim 7, wherein said fins are secured to said polarizer so as to be mounted in facing relationship to one another but offset laterally from one another.

9. The antenna of claim 1 wherein said fin assembly further comprises a first end and a second end, said first end having a plurality of tuning slots and said second end comprising dual curved profiles.

10. The antenna of claim 1 further comprising a feed point formed within said fin assembly for accepting said electrical connector for enabling tuning of said antenna.

11. The antenna of claim 10 wherein said electrical connector comprises a coaxial cable, said coaxial cable passing through said polarizing member and connecting to said fin assembly.

12. An antenna for communicating circularly polarized radio frequency signals, comprising:

a polarizing member;

a plurality of non-planar fin components each having a plurality of fins, said fin components forming a fin assembly when connected to said polarizing member in generally facing relationship to one another, said fin assembly having a first end and a second end; and an electrical connector for electrically coupling said antenna to an external device, said electrical connector passing through said polarizer and connecting to at least one of fin components said fin.

13. The antenna of claim 12 wherein said polarizing member comprises a dielectric member and includes a longitudinal slot centered about a transverse width of said polarizing member.

14. The antenna of claim 12 wherein said fin assembly further comprises at least one tuning slot, said at least one tuning slot situated transversally to a longitudinal axis of said fin and proximate to said first end of said fin assembly.

15. The antenna of claim 14 wherein said fins include an opening defining a feed point to accommodate said electrical connector.

16. The antenna of claim 15 wherein said fins further comprise dual curved edges originating along an inner longitudinal fold of each said fin component and progressing to an outside corner of each said fin component.

17. The electrical connector of claim 15 wherein said electrical connector further comprises an exterior connector portion and an interior connector portion, said exterior connector portion interfacing with said feed point of a first fin and making contact with said first fin of the antenna and said interior connector portion interfacing with said feed point of a second fin and making contact with said second fin of the antenna.

18. The antenna of claim 12, wherein each said fin component further comprises a flattened portion along an exterior side opposite an interior fold thereof.

19. An antenna comprising:

a polarizing member, wherein said polarizing member is non-conducting and defines a transversally centered longitudinal slot; and a plurality of non-planar fins mechanically connected to opposing sides of said polarizing member, each fin having a first end and a second end wherein said fins further comprise a plurality of tuning slots situated transversally to a longitudinal axis of said fins and proximate to a first end of said fins and wherein said fins further define a through hole to accommodate an electrical connection.

20. The antenna of claim 19 wherein said polarizing member permits the antenna to communicate in a circularly polarized fashion.

21. The antenna of claim 20 wherein said circularly polarized fashion further comprises receiving vertically polarized waves and horizontally polarized waves and converting them to circularly polarized waves for transmission and receiving circularly polarized waves and generating vertically or horizontally or elliptically or circularly polarized waves for transmission.

22. The fins of claim 19 wherein said fins are formed to include an angle of between zero and 180 degrees.

* * * * *